US006686014B1

(12) United States Patent
Washburn et al.

(10) Patent No.: US 6,686,014 B1
(45) Date of Patent: Feb. 3, 2004

(54) REDUCTION OF ADHESIVE OOZE BY PATTERN OVERCOATING

(75) Inventors: David E. Washburn, Kettering, OH (US); Stephen D. Webendorfer, Miamisburg, OH (US); Rajendra Mehta, Centerville, OH (US); David F. Laurash, Bellbrook, OH (US)

(73) Assignee: The Standard Register Company, Dayton, OH (US)

( * ) Notice: Subject to any disclaimer, the term of this patent is extended or adjusted under 35 U.S.C. 154(b) by 94 days.

(21) Appl. No.: 09/847,748

(22) Filed: May 2, 2001

(51) Int. Cl.[7] ..... G09F 3/00

(52) U.S. Cl. ..... 428/40.1; 281/2; 281/5; 283/81; 428/41.3; 428/41.7; 428/41.9; 428/42.1; 428/42.2; 428/42.3; 428/43; 428/192; 428/194

(58) Field of Search ..... 428/40.1, 41.3, 428/41.7, 41.9, 42.1, 42.2, 42.3, 43, 192, 194; 283/81; 281/2, 5

(56) References Cited

U.S. PATENT DOCUMENTS 4,022,926 A 5/1977 Keough et al.
4,287,255 A * 9/1981 Wong ..... 428/343
4,759,982 A 7/1988 Jenssen et al.
5,271,787 A 12/1993 Hoffmann et al.
5,351,426 A 10/1994 Voy et al.
5,632,842 A * 5/1997 Oliver ..... 283/81
5,700,536 A 12/1997 Steidinger
5,829,788 A * 11/1998 Jackson ..... 283/81
5,885,677 A 3/1999 Gosselin et al.
5,975,582 A 11/1999 Treleaven
6,398,263 B2 * 6/2002 Treleaven ..... 283/81

* cited by examiner

*Primary Examiner*—Nasser Ahmad
(74) *Attorney, Agent, or Firm*—Dinsmore & Shohl LLP

(57) ABSTRACT

A pattern of coating is applied to a label, such that the coating covers the periphery, including a portion of the top surface of the label, and overlaps onto the liner ply area adjacent to the label. The coating is selected to form a stable and resistant film that spans continuously along the label edge and liner surfaces. The coating reduces adhesive ooze when the label is exposed to elevated ambient temperatures and pressures.

48 Claims, 8 Drawing Sheets

REDUCTION OF ADHESIVE OOZE BY PATTERN OVERCOATING

BACKGROUND OF THE INVENTION

The present invention relates in general to a label product and in particular to an improved label product that minimizes cold flow of adhesive along label edges.

Some pressure sensitive adhesives used in the manufacture of forms and labels are known to cold flow, or ooze, when exposed to combinations of elevated ambient temperatures and pressures. Essentially, the adhesive creeps out from under the cut edges of the label resulting in exposed adhesive that can leave deposits, clog machinery, and cause items to stick to the exuded adhesive. Conditions that lead to adhesive oozing can be encountered in both the storage of forms as well as the processing of forms.

Where forms are stacked in either cut sheet, or in folded or rolled form, the pressure of the layers can sometimes cause adhesive ooze. Likewise, when processing forms, ooze may cause the contamination of printers and other machinery. For example, laser printers are susceptible to adhesive ooze due to the heat and pressure internal to the printer. Labels may stick to components inside the printer, or in stacking trays or feeding trays.

One known label construction that attempts to avoid the problem of adhesive ooze is to apply pressure sensitive adhesive in a pattern that extends along the back surface of the label ply, but stops short of the label edge, thus the periphery of the label is adhesive free. While this approach may reduce adhesive ooze, the adhesive free edges can become prone to lifting, folding over, or otherwise obstructing machinery, and can further affect stacking of forms in feed and output trays. Another label construction involves pattern coating an adhesive to create a gap beneath the label free of adhesive. This may lead to adhesive migrating to the adhesive free region under the label instead of migrating beyond the periphery of the label. However, there is nothing that positively prevents adhesive from migrating from the outer periphery of the label. While some adhesive may fill the gap, depending upon gap placement, other adhesive may still creep out from the outer periphery. Further, the back surface of the label is not full coated with adhesive, which may compromise the strength and utility of the label. In addition, most pattern adhesive labels are a custom manufactured product resulting in higher cost of production.

Yet another solution involves applying a pattern coating of silicone to the liner ply. The liner ply is silicone free about the periphery of the label. A die cut contours the periphery of the label, set inward a predetermined amount. The adhesive bonds the back of the label ply to the silicone free portion of the liner ply, about the periphery, avoiding the migration of adhesive ooze outside the periphery of the label. However, this label construction can be difficult to practice. The labels may rip or tear where the edges of the label are adhered to the liner in a silicone free area. Further, it may be difficult applying the pattern of silicone to the liner ply in the pattern required to contain the ooze.

Accordingly, there is a need for an improved label construction that reduces adhesive ooze.

SUMMARY OF THE INVENTION

The present invention overcomes the disadvantages of previously known label constructions that reduce adhesive ooze from exuding from a label edge by providing a label having a barrier coating that forms a stable and resilient film over at least a portion of the label periphery, and overlaps an area adjacent to the label periphery. The barrier coating traps adhesive ooze that may exude from a label edge. The area adjacent to the label periphery may comprise a liner ply, a form ply, or an adjacent label ply.

BRIEF DESCRIPTION OF THE SEVERAL VIEWS OF THE DRAWINGS

The following detailed description of the preferred embodiments of the present invention can be best understood when read in conjunction with the following drawings, where like structure is indicated with like reference numerals, and in which.

DETAILED DESCRIPTION OF THE PREFERRED EMBODIMENTS

Figure 1:
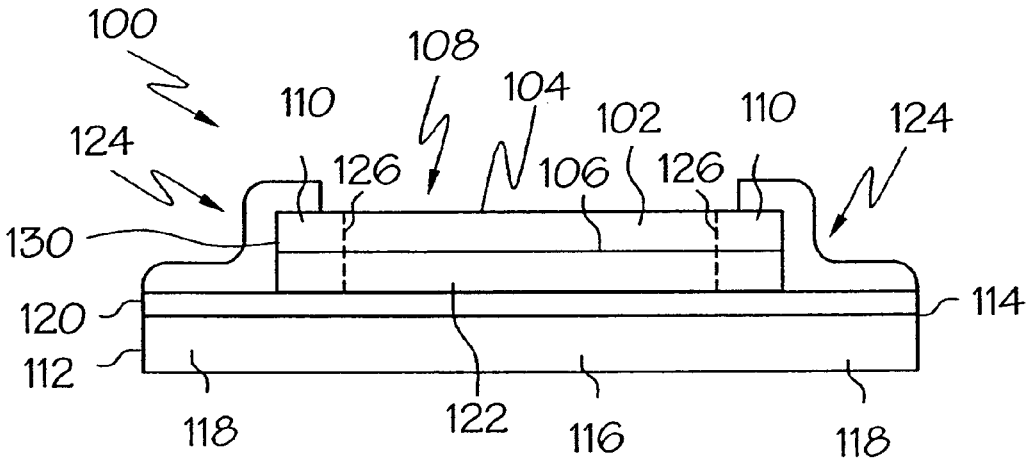
FIG. 1 is a cross sectional view of a label on a release coated liner ply having a barrier coating that straddles the label perimeter.

In the following detailed description of the preferred embodiments, reference is made to the accompanying drawings that form a part hereof, and show by way of illustration, and not by way of limitation, specific preferred embodiments in which the invention may be practiced. It is to be understood that other embodiments may be utilized and that changes may be made without departing from the spirit and scope of the present invention. The accompanying drawings are diagrammatic figures and as such, the dimensions are not shown to scale. Further, like structure is indicated with like reference numerals throughout.

As shown in FIG. 1, the label 100 according to a first embodiment of the present invention is illustrated. A label ply 102 has a label face 104, a label back 106, a first portion 108, and a label periphery 110. The first portion 108 is located generally in the central portion of the label ply 102, and extends out to the label periphery 110. A liner ply 112 has a ply face 114 and is generally delineated into a first region 116 and a second region 118. The first region 116 and the label ply 102 are substantially similar. By substantially similar, it is meant that the label ply 102 and the first region 116 of the liner ply 112 are approximately the same size and shape. A release coating 120 is applied to the ply face 114 as is known in the art. An adhesive 122 is applied between the label back 106 and the liner face 114 such that the label ply 102 is releasably fixed to the liner ply 112, and the label ply 102 is aligned substantially in register with the first region 116 of the liner ply 112. The release coating 120 typically exhibits a very low surface energy, which allows a substantial portion of the adhesive 122 to release with the label back 106 once the label 102 and liner ply 112 are separated by a user.

To reduce cold flow, or adhesive ooze, the label 100 includes a barrier coating 124. The barrier coating 124 forms a continuous, stable and resistant film on the label face 104, and extends onto the liner face 114. Thus the barrier coating 124 acts as a sealant or barrier effectively trapping the adhesive 122 that may otherwise tend to exude from the edges of the label 100.

Figure 2:
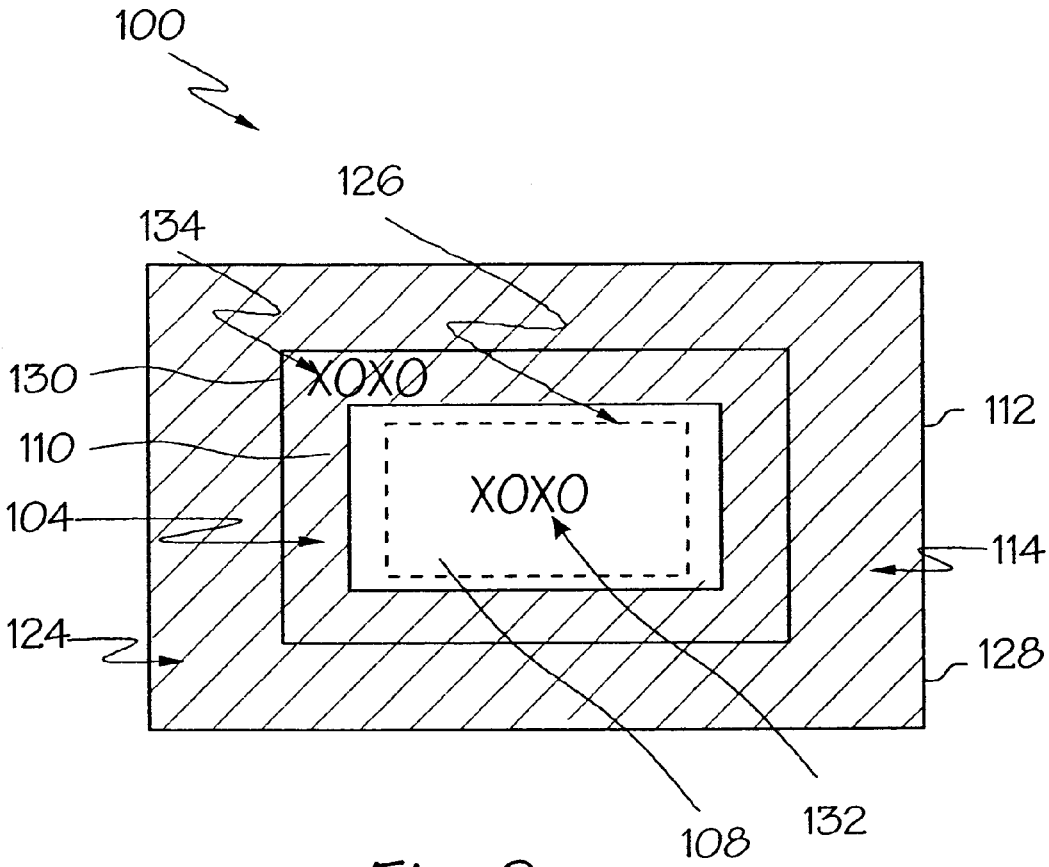
FIG. 2 is a top view of the label according to FIG. 1.

Referring to FIG. 2, the barrier coating 124 is illustrated with diagonal lines. The barrier coating 124 does not need to extend to the liner edge 128 so long as the barrier coating 124 straddles the label periphery 110 and extends onto the liner ply 112 adjacent to the label periphery 110. The barrier coating 124 should be applied to the label 100 in a sufficient amount to minimize the amount of adhesive 122 (not shown in FIG. 2) that may exude beyond the label edge 130. It will be observed that other label construction techniques may be used with the present invention as are known in the art As illustrated in FIG. 2, the label 100 includes a score or perforation 126, and indicia 132, 134 anywhere on the label face 104. Indicia 132 is positioned within the first portion 108 of the label face 104. Indicia 134 is positioned within the label periphery 110 of the label face 104. Indicia 134 may be applied either over or under the barrier coating 124. The barrier coating 124 maybe receptive to inks allowing a user to print directly on the barrier coating 124. For example, the user may print on the label face 102 using laser and inkjet printers, thermal, impact or any other suitable device.

Referring back to FIG. 1, it will be appreciated that the barrier coating 124 prevents or at least minimized the amount of adhesive 122 that may exude out from under the label ply 102. However, the adhesive 122 that does exude will remain trapped underneath the barrier coating 124. Under certain circumstances, such as where labels are stored in a stacked configuration, adhesive may tend to exude from the label edges. As a consequence, vertically adjacent labels may become adhered to one another because the exposed adhesive of a first label will stick to the back of a label stacked directly above. However, labels including the barrier coating 124 according to the present invention will be immune to the above problem because the barrier coating 124 prevents adhesive 122 from exuding, and the adhesive 122 that does exude will remain trapped underneath the barrier coating. Because the barrier coating 124 is preferably not tacky, stacked labels will not stick together. It will be appreciated that numerous other advantages may be realized by using the barrier coating 124 according to the present invention.

The label ply 102 may be formed from any suitable material including for example, paper, latex impregnated paper, coated paper, thermal sensitive paper, synthetic paper, bond paper, tag, thermal sensitive film, polyolefin, polypropylene, polyester film, and vinyl. For example, plastic or film may be a preferable label material for certain applications, however it does create problems when storing such labels in a stacked fashion. The plastic material typically exhibits a particularly flat surface allowing adhesive to ooze. Further, plastics and films can shrink or otherwise deform further allowing adhesive to ooze. Because the barrier coating 124 reduces adhesive ooze, the present invention is particularly useful for use on plastic or film labels. Further, the label ply may be rectangular, ellipsoidal, polygonal, curvilinear or any other shape or size depending on user requirements.

The type of adhesive 122 will depend upon user requirements, such as the intended surface to which the label 100 is to be applied, and other like considerations. For example, permanent, cold temperature, removable, and repositionable pressure sensitive adhesives may be used. The type of release coating 120 used will depend upon the adhesive selected, however, examples of suitable release coatings include UV cured silicone, a water soluble silicone oil, a silicone oil emulsion, silicone rubber emulsion or wax type repellants. Coating materials suitable for use as the barrier coating 124 include protective varnishes, water based over-print varnishes, ultra violet cured over-print varnishes, toner enhancement coatings, ultraviolet cured silicones, and water-based silicones. It will be appreciated that other coating materials may be used without departing from the spirit of the present invention.

The label 100 may optionally include a score 126 around the label 102. As illustrated in FIGS. 1 and 2, the score 126 generally delineates the first portion 108 from the label periphery 110. The score 126 may be any line of weakness, perforation, or die cut as is known in the art. The score 126 leaves enough of the label ply 102 uncut so as to securely maintain the first portion 108 with the liner ply 112 during processing through printers and other machinery, however, upon use, the first portion 108 releases easily from the remainder of the label 100 as a user peels the first portion 108 away. Where the barrier coating 124 is applied to the label ply 102 only along the label periphery 110, the first portion 108 may be separated from the label periphery 110 by peeling the first portion 108 from the liner ply 112. When the first portion 108 is removed from the liner ply 112, no portion of the barrier coating 118 is evidenced on the first portion 108.

Figure 3:
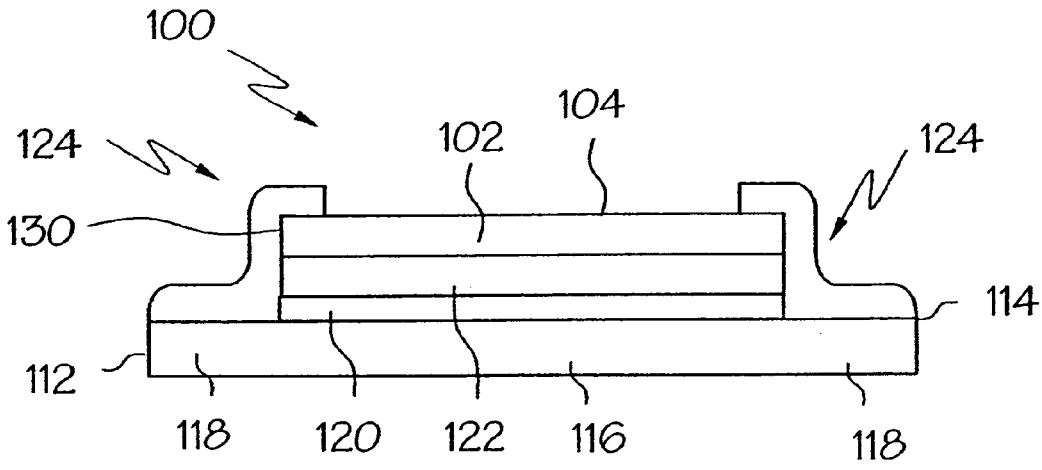
FIG. 3 is a cross sectional view of a label on a release coated liner ply having a barrier coating that overlies the label perimeter and a non-release coated portion of the liner ply.
Figure 4:
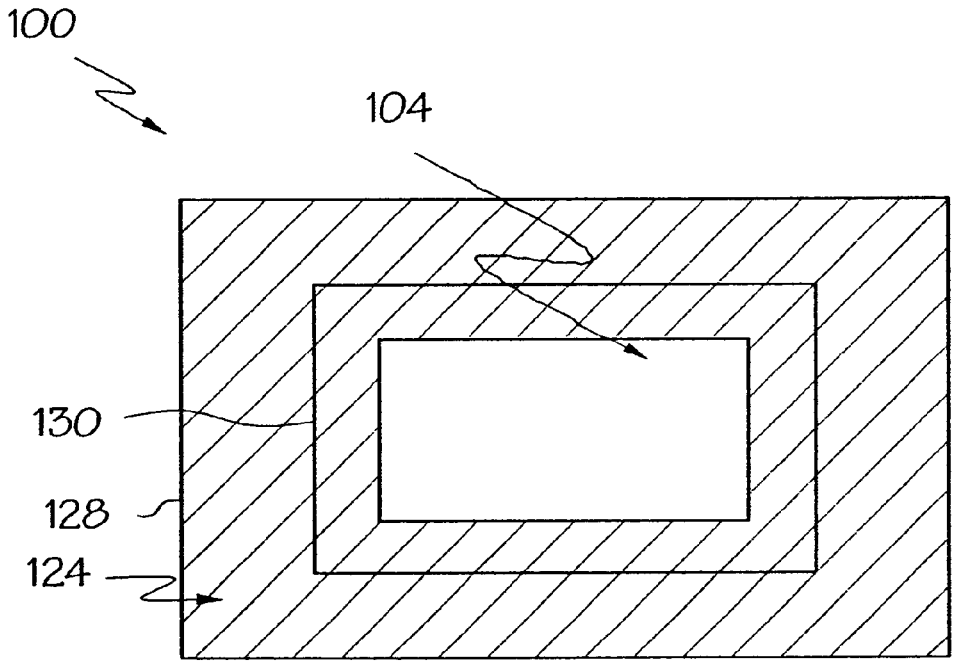
FIG. 4 is a top view of the label according to FIG. 3.

Depending upon the selection of the materials for the barrier coating 124, it may be desirable to apply the release coating 120 to the ply face 114 of the liner ply 112 such that the release coating 120 avoids the area where the barrier coating 124 is applied. For example, it may be undesirable to apply a silicone barrier coating to a silicone release coating. Referring to FIG. 3, a label 100 is illustrated. It should be observed that the label construction is identical to that of FIG. 1, except that the release coating 120 is pattern applied so that at least a portion of barrier coating 124 is in contact with the liner face 114 in an area not covered by the release coating 120. Further, it will be observed that features known in the art, such as printed indicia, perforations, etc. are not shown in FIG. 3 to facilitate discussion. As illustrated, the release coating 120 is applied to the ply face 114 of the liner ply 112, within the first region 116. There is little to no release coating 120 on the ply face 114 of the liner ply 112 within the second region 118. Of course, to allow for affixing tolerances, the release coating 120 may extend slightly beyond the label periphery 110. Referring to FIG. 4, the barrier coating 124 is applied to the label face 104 in a pattern straddling the label periphery 110. As such, the barrier coating avoids the first portion 108, overlies the label periphery 110, and overlaps onto the liner ply 112 adjacent to the label edge 130.

Figure 5:
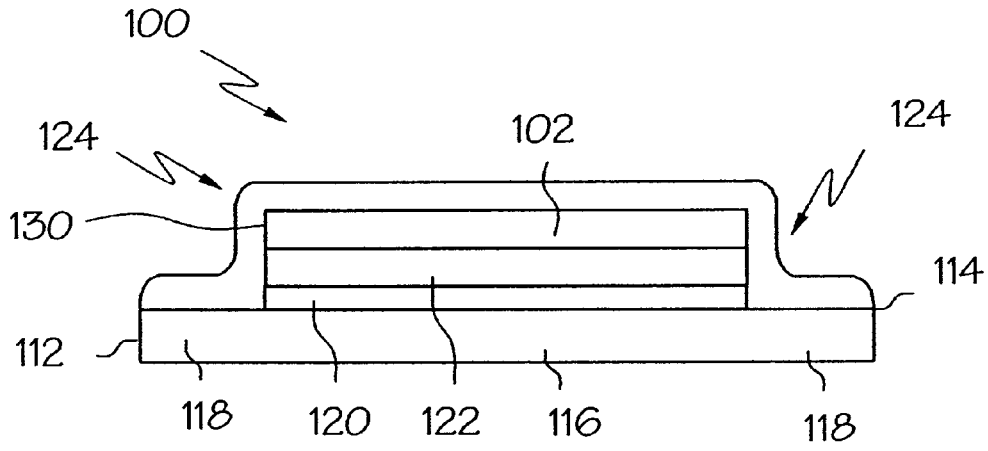
FIG. 5 is a cross sectional view of a label on a release coated liner ply having a barrier coating that overlies the label and a non-release coated portion of the liner ply.
Figure 6:
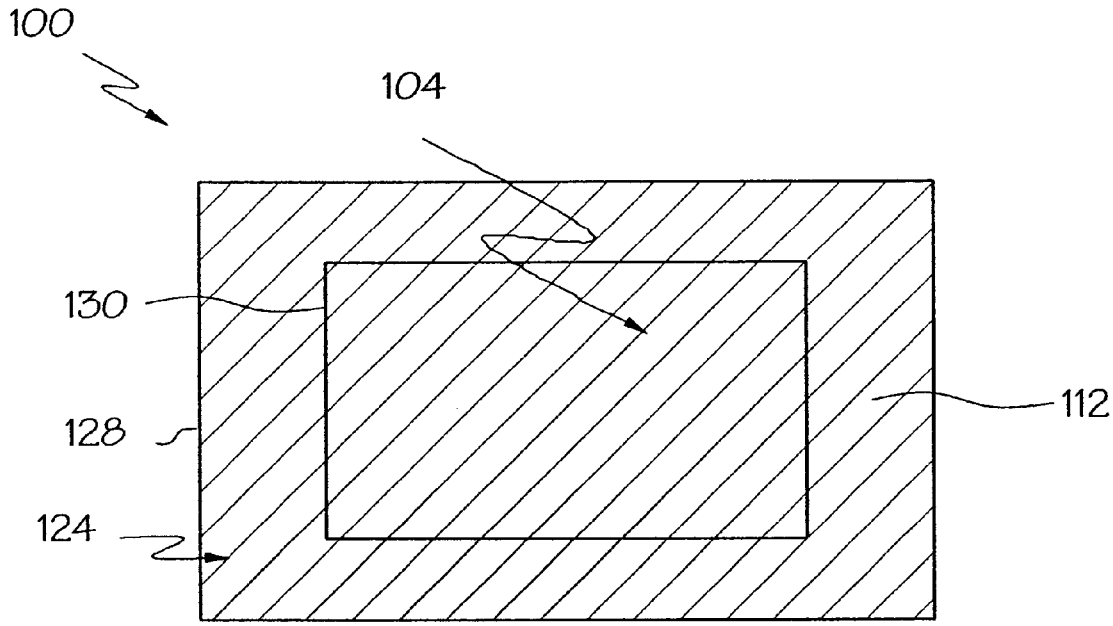
FIG. 6 is a top view of the label according to FIG. 5.

Referring to FIGS. 5 and 6, the barrier coating 124 may be applied so as to overlie substantially the entire label face 104. The release coating 120 is shown in FIG. 5 applied to the ply face 114 in a pattern so that at least a portion of the barrier coating 124 does not overlie the release coating 120. For example, the second region 118 defines an area designating generally, the periphery of the liner ply 112. The second region 118 circumscribes the first region 116. The release coating 120 is applied generally to the first region 116 of the liner ply 112 and defines a release coat free area around the second region 118. It will be observed that the release coating 120 may alternatively be applied to substantially the entire ply face 114 as shown in Fig. 1. Referring to FIG. 6, the barrier coating 124 is applied to the label 100 so as to overlie the label face 104, and straddle the label edge 130 onto the liner ply 112. As shown, the barrier coating 124 extends to the liner edge 128, however, in practice, this need not be the case, so long as the barrier coating straddles the label edge 130 and extends onto the liner ply 112 adjacent to the label edge 130.

Referring back to FIG. 5, the adhesive 122 is prevented from exuding beyond the barrier coating 124. It should be observed that, upon completion of manufacturing the label 100, the top of the barrier coating 124 is tack free. As such, any adhesive that may exude beyond the label periphery will be trapped underneath the barrier coating 118. Accordingly, a plurality of labels may be stacked or otherwise processed, without adhesive sticking labels together, or otherwise causing jams in equipment.

Figure 7:
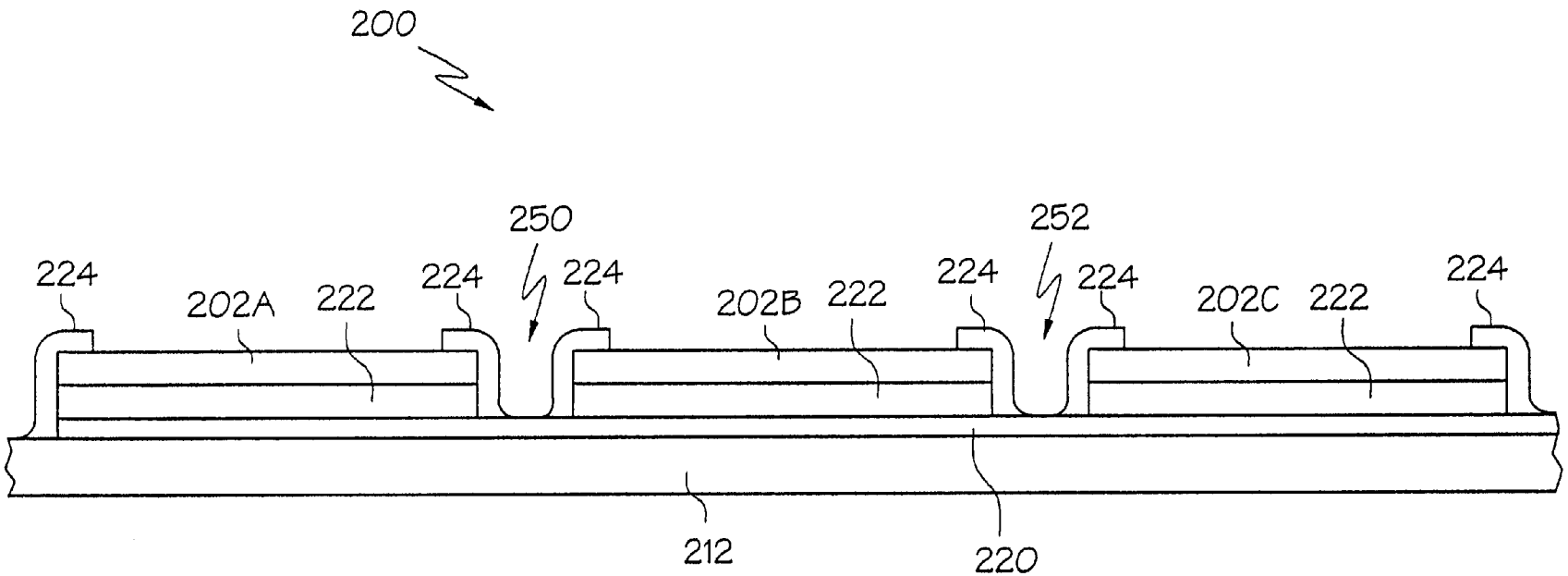
FIG. 7 is a cross sectional view of a label sheet comprising multiple, non-adjoining labels on a liner ply, each label having a barrier coating that straddles the label perimeter.
Figure 8:
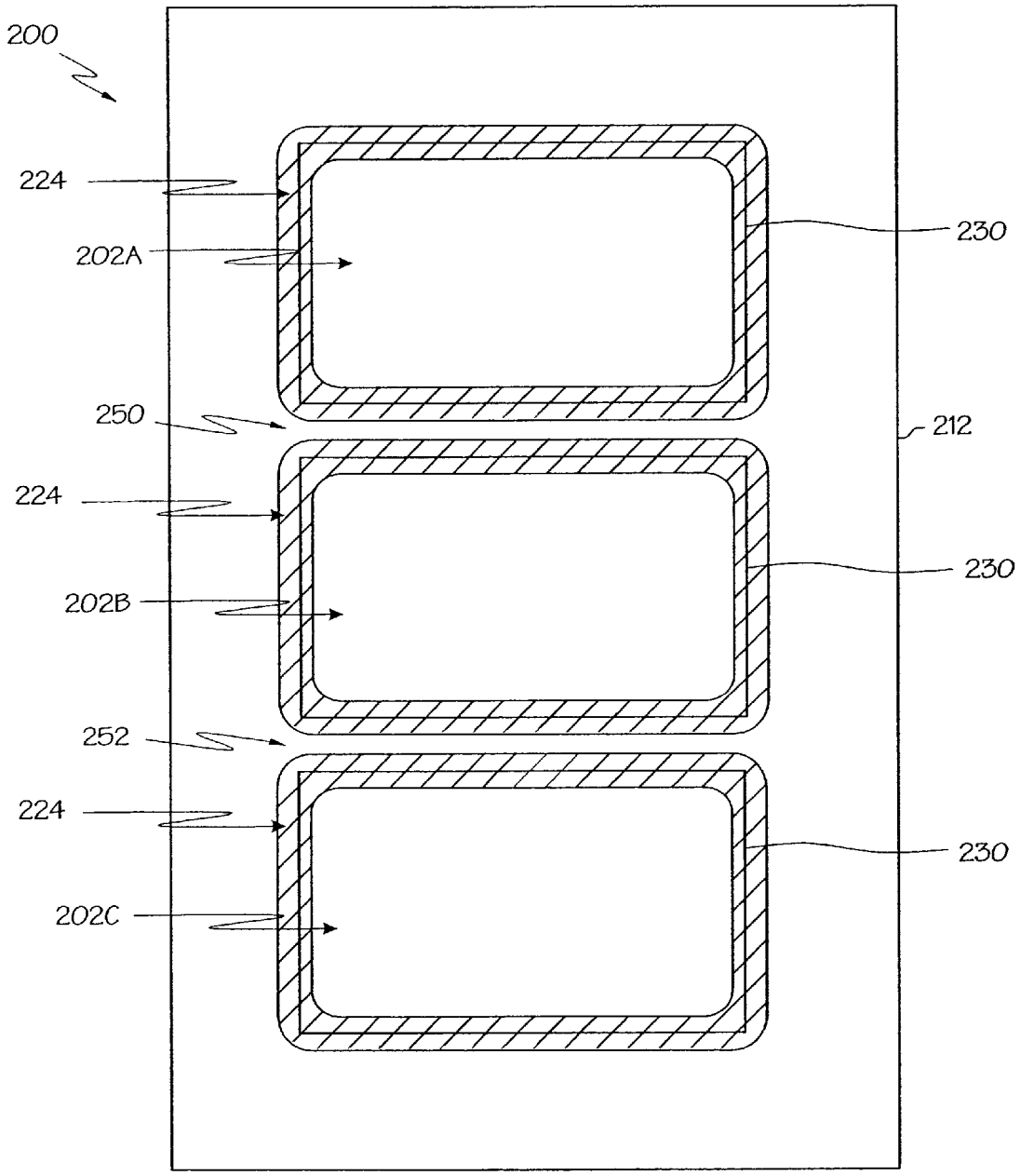
FIG. 8 is a top view of the labels according to FIG. 7.

As shown in FIGS. 7 and 8, the illustrated label construction is similar to the label construction of FIGS. 1–6. As such, like structure is indicated with a reference numeral 100 higher than the corresponding structure in FIGS. 1–6. As shown in FIG. 7, a plurality of label plies 202A, 202B, and 202C are releasably secured to a single liner ply 212 by adhesive 222 to define a label sheet. The label plies 202A, 202B, and 202C are arranged in a non-abutting fashion. Label ply 202A is separated from label ply 202B by area 250. Label ply 202B is separated from label ply 202C by area 252. Referring to FIG. 8, the barrier coating 224 straddles the label edge 230 of each of the labels 202A, 202B, and 202C. It should be observed that the barrier coating 224 may be applied so as to span adjacent labels. For example, the barrier coating 224 may span across areas 250 and 252 so that the barrier coating 224 may be applied continuously. Release coating 220 covers substantially the entire liner ply 212. However, the release coating 220 may be pattern applied as discussed above such that the barrier coatings 224 overlie the label ply 202 and extend onto release coat free areas of the liner ply 212 (not shown in FIG. 8). While the label plies 202A, 202B, 202C are shown aligned in a single column, it should be appreciated that any organization and quantity of label plies 202A, 202B, 202C on the liner ply 212 may be realized without departing from the spirit of the present invention.

Figure 9:
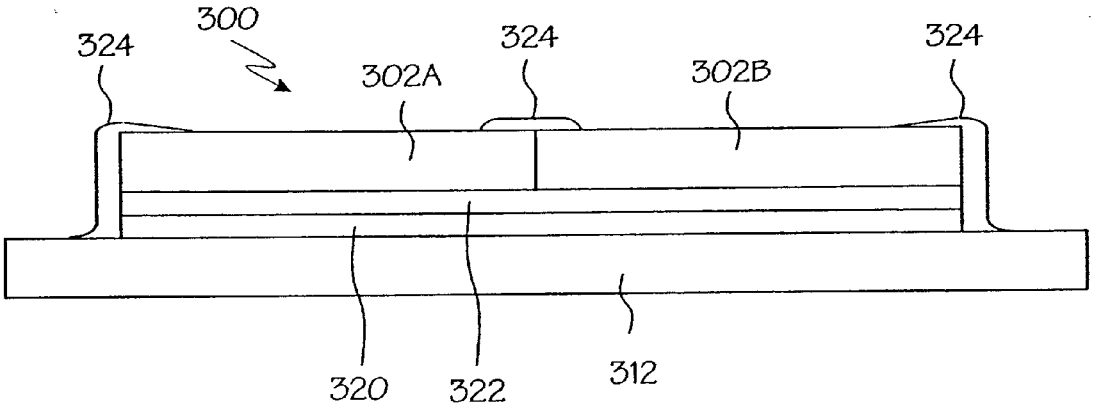
FIG. 9 is a cross sectional view of a multiple, adjoining labels on a liner ply, each label having a barrier coating that straddles the label perimeter.
Figure 10:
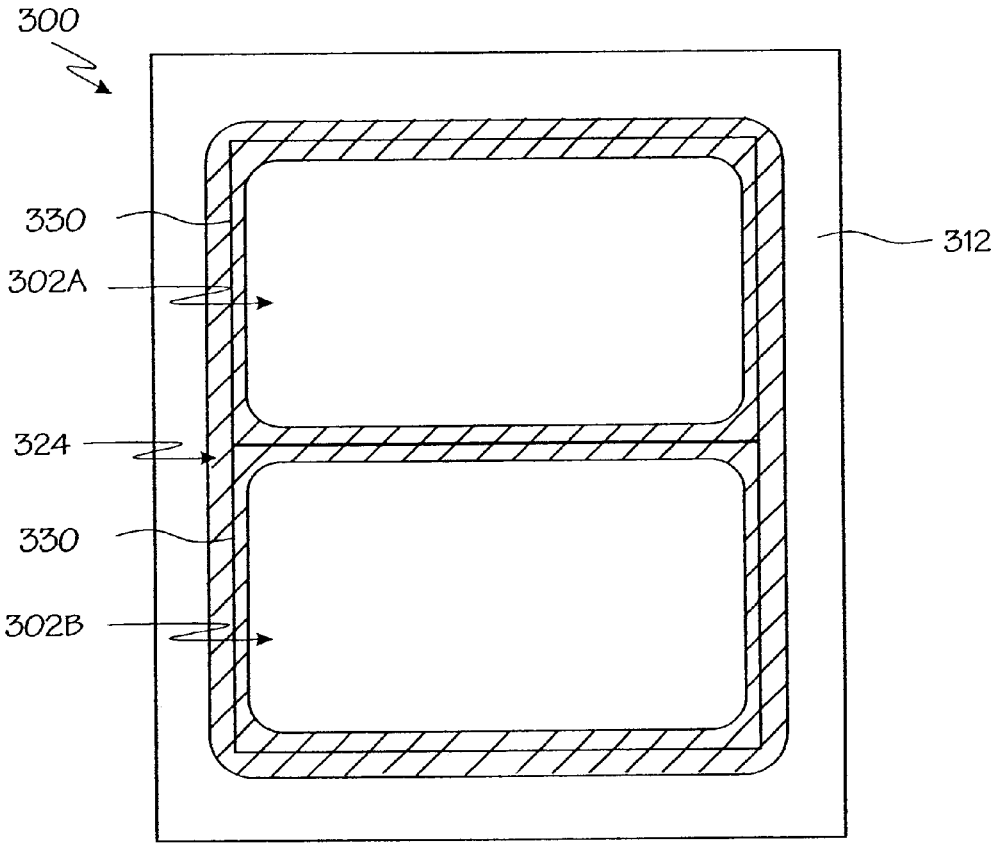
FIG. 10 is a top view of the labels according to FIG. 9

Referring to FIGS. 9 and 10, the illustrated label construction is similar to the label construction of FIGS. 7 and 8. As such, like structure is indicated with a reference numeral 100 higher than the corresponding structure in FIGS. 7 and 8. As can be seen, the label plies 302A and 302B are abutting. Referring to FIG. 9, the abutting labels 302A and 302B may be separated by die cuts, scores, perforations or using any other technique as is known in the art. The barrier coating 324 bridges between the label plies 302A and 302B. Referring to Fig.10, the barrier coating 324 straddles the label edge 330 of the label plies 302A and 302B and extends onto the liner 312 adjacent to the label plies 302A and 302B. Referring to FIG. 9, it shall be observed that the release coating 320 may also be applied to the entire liner ply 312.

Figure 11:
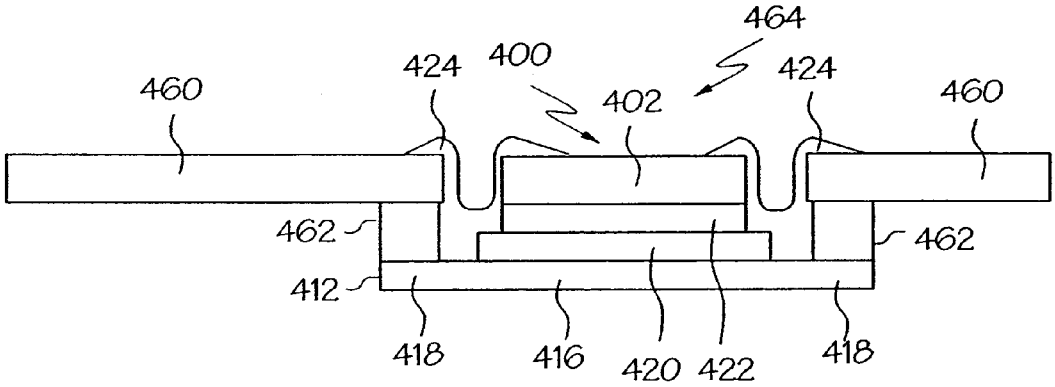
FIG. 11 is a cross sectional view of a form having a label secured thereto, the label being releasably held to a liner patch and nested in a window of the form, where a barrier coating bridges the label periphery and areas of the form adjacent to the window.

Referring to FIG. 11, the label construction 400 according to the present invention may be applied to a form. The illustrated label construction 400 applied to the form is similar to the label construction of FIGS. 1–6. As such, like structure is indicated with a reference numeral 300 higher than the corresponding structure in FIGS. 1–6. A form 460 includes a window 464 cut therethrough. The window 464 is preferably slightly larger in dimensions than the label ply 402. A label ply 402 is positioned in the window 464 of the form 460. A coating of adhesive 422 releasably secures the label ply 402 to a liner ply 412. The liner ply 412 is pattern coated with a release coating 422 such that the release coating is applied to the first region 416.

There is no release coating applied to the second region 418 of the liner ply 412 as illustrated. The second region 418 defines the periphery of the liner ply 412. Adhesive 462 is applied between the second region 418 of the liner ply, the form 460 adjacent to the window 464. Because the adhesive 462 is used to secure the liner ply 412 to the back of the form 460, it is preferable to pattern coat the release coating 422 so that the second region 418 is release coat free. It shall be observed that the release coating 422 may alternatively coat substantially the entire face of the liner ply 412. In a preferred construction, the barrier coating 422 is a water based protective varnish. Further, the release coating 420 is a silicone based release coat. The barrier coating 424 straddles the periphery of the label ply 402 and bonds to the silicone free areas of the liner ply 412. As illustrated in FIG. 11, the barrier coating 424 extends from the periphery of the label ply 402 through the window 464 and onto the form 460. However, it shall be appreciated that the barrier coating 424 need only extend from the periphery of the label ply 402 onto the liner ply 412 within the window 464, and need not extend out from the window 464 and onto the form 460.

Figure 12:
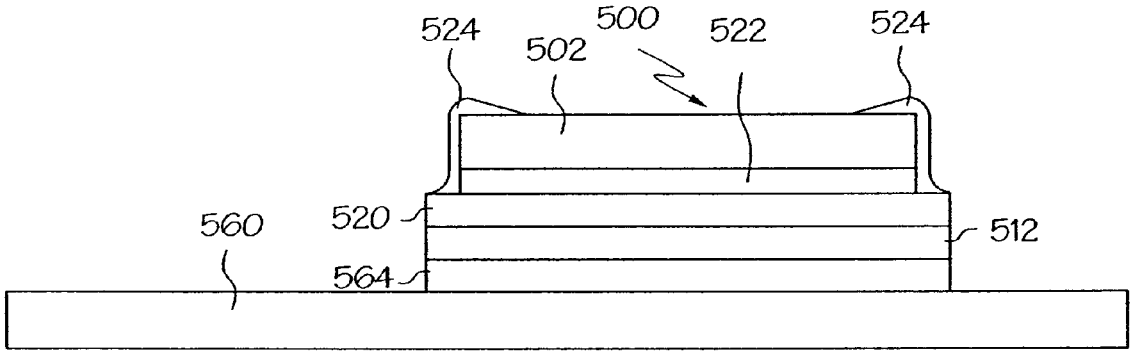
FIG. 12 is a cross sectional view of a label piggybacked to a form, where a barrier coating is applied between the label periphery and a liner ply.
Figure 13:
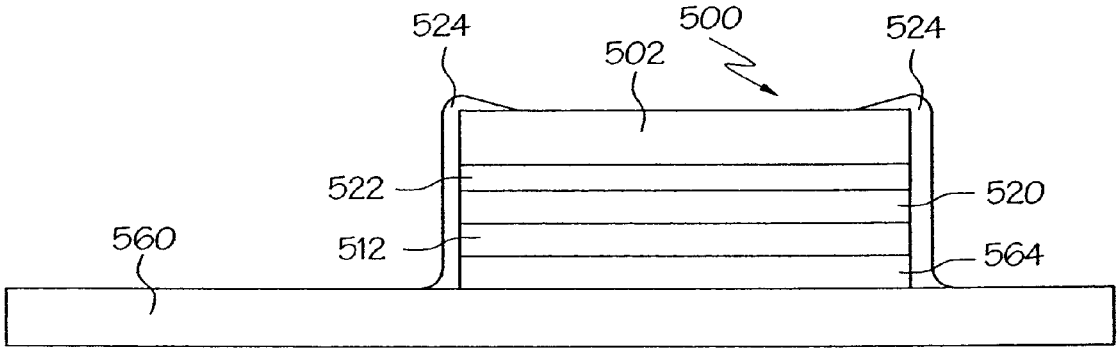
FIG. 13 is a cross sectional view of a label piggybacked to a form, where a barrier coating is applied between the label periphery and the form adjacent to the piggybacked label; and, FIG. 14 is a top view of a form incorporating the label construction according to FIG. 11.

The label may also be applied to a form in a piggyback fashion as shown in FIGS. 12 and 13. The illustrated label construction 500 applied to the form is similar to the label construction of FIG. 11. As such, like structure is indicated with a reference numeral 100 higher than the corresponding structure in FIG. 11. Referring to FIG. 12, the label 500 is applied to the form 560 in a piggyback fashion. A label ply 502 is releasably secured to a liner ply 512 by adhesive 522. A release coating 520 is applied to the face of the liner ply 512. As shown, the release coating 520 covers substantially the entire face of the liner ply 512. The release liner 512 is held to the form 560 by adhesive 564. A barrier coating 524 is applied to the label 500 so as to straddle the periphery of the label ply 502 and extend onto the liner ply 512. As shown in FIG. 12, the barrier coating 524 overlies and adheres to the release coating on the liner ply. However, as more fully explained herein, the release coating 520 may be applied in a pattern such that the release coating 520 does not coat the entire face of the liner ply 512 as more fully explained herein. For example, the release coating 520 may be applied so as to substantially align in register with the adhesive 522. Under this arrangement, the barrier coating 524 straddles the periphery of the label ply 502, and extends on to a non-release coated portion of the liner ply 512.

Referring to FIG. 13, a label is applied to a form in a piggyback fashion. The label construction is similar to that shown with respect to FIG. 12. As such, like structure is shown with like reference numerals. A label ply 502 is releasably secured to a liner ply 512 by adhesive 522. A release coating 520 is applied to the face of the liner ply 512. The release liner 512 is held to the form 560 by adhesive 564. A barrier coating 524 is applied to the label 500 so as to straddle the periphery of the label ply 502 and extend beyond the liner ply 512 to the form 560.

Figure 14:
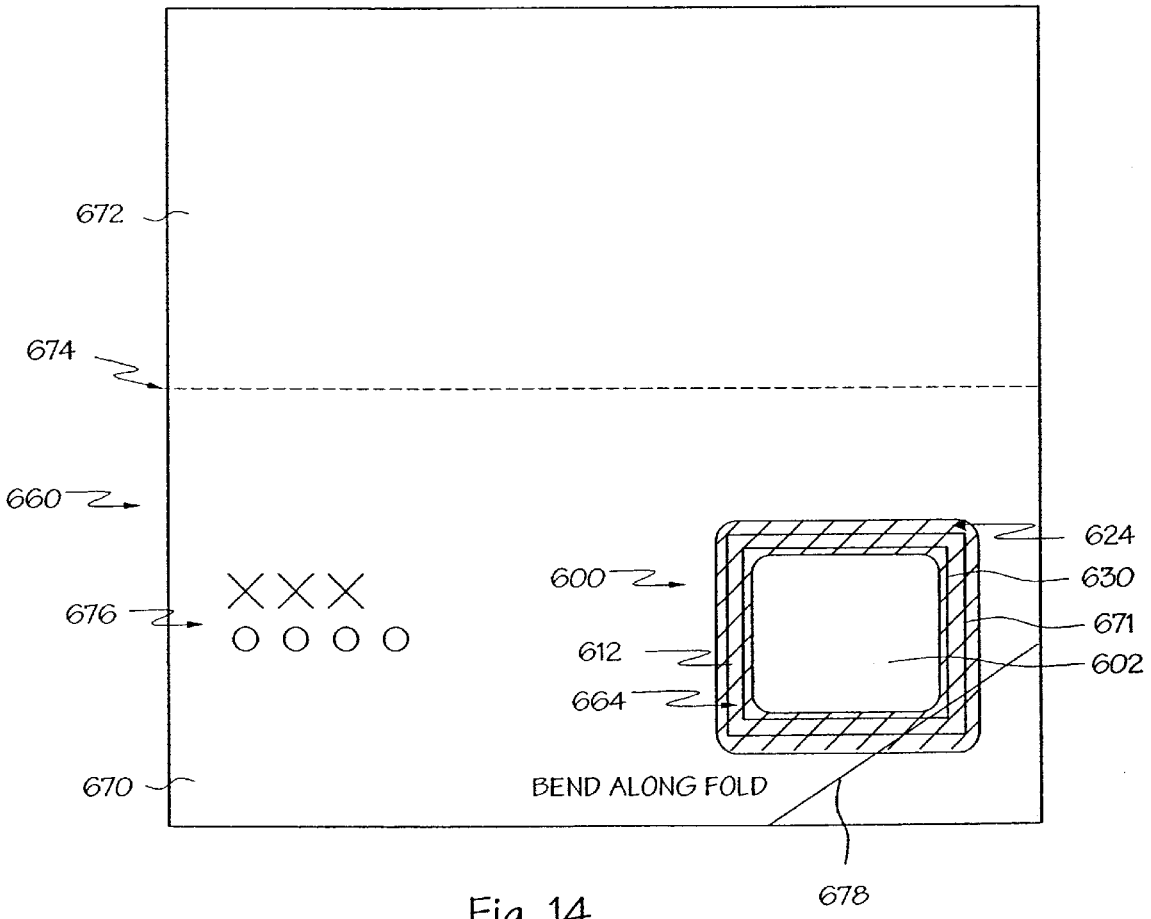

A specific example of a form and label is illustrated in FIG. 14. A form 600 is used by a state agency for dispensing licensing labels. While either the window construction discussed with reference to FIG. 11, or the piggyback label construction discussed with reference to FIGS. 12 and 13 may be used with the form according to the present invention, FIG. 14 will be discussed as incorporating the window construction discussed more thoroughly with respect to FIG. 11. As such, like structure is indicated with a reference numeral 200 higher than the corresponding structure in FIG. 11.

A license, in the form of a label ply 602 is secured within a window 664 of the form 660. The label ply 602 is releasably secured to a liner 612 as more fully described with reference to FIG. 11. The barrier coating 624 straddles the label edge 630, extends through the window 664, and may extend onto the face of the form 660 beyond the window edge 671. The form may include printed indicia 676 anywhere on the form, including on the label ply 602. For example, the form may contain instructions on how to apply the license label, as well as provide other information. Further, the form 660 may include a line of weakening 674 dividing the form 660 into a first portion 670 and a second portion 672. This arrangement allows the first portion 670 to be separated from the second portion 672. For example, the second portion 672 contains useful information regarding registration, which may be filed away for safekeeping. The first portion 670 contains the label ply 602. As shown, the form 660 includes a fold line 678 positioned in the lower right hand corner of the form. The fold line 678 crosses over a corner portion of the label ply 602. By folding the form along the fold line 678, a corner portion of the label ply is freed from the form 660. For example, the barrier coating 624 is broken free from the form 660, thus assisting a user with removal of the label ply 602 from the form 660.

Having described the invention in detail and by reference to preferred embodiments thereof, it will be apparent that modifications and variations are possible without departing from the scope of the invention defined in the appended claims.

What is claimed is:

1. A label comprising:

a label ply having a label face and a label back;

a liner ply having a first region and a second region;

an adhesive applied between said label back and said liner ply such that said label ply is aligned substantially in register with, and releasably held to said first region of said liner ply; and a barrier coating arranged to overlap at least a portion of said label face and said second region of said liner ply so as to limit said adhesive from exuding beyond said barrier coating by passing thereunder.

2. A label according to claim 1, wherein said second region circumscribes said first region.

3. A label according to claim 1, wherein said label ply has a label periphery, and said barrier coating overlaps said label periphery and said second region of said liner ply adjacent to said label periphery.

4. A label according to claim 1, wherein said label ply has a first portion bounded by a label periphery, and said barrier coating overlaps said label periphery and said second region of said liner ply adjacent to said label periphery avoiding said first portion of said label ply.

5. A label according to claim 4, wherein said label ply further comprises a score separating said first portion from said label periphery.

6. A label according to claim 1, wherein said barrier coating forms a continuous film.

7. A label according to claim 1, wherein said barrier coating is a protective varnish.

8. A label according to claim 1, wherein said barrier coating is a toner enhancement coating.

9. A label according to claim 1, wherein said barrier coating is silicone.

10. A label according to claim 1, wherein said barrier coating overlies said label ply entirely, and extends onto said second portion of said liner ply.

11. A label according to claim 1, wherein said liner ply has a liner face, said entire liner face coated with a release coating.

12. A label according to claim 1, wherein said liner ply has a liner face, said liner face pattern coated with a release coating defining a release coat free area such that at least a portion of said barrier coating overlies said release coat free area of said liner ply.

13. A label according to claim 1, wherein said label is adhered to a form.

14. A label comprising:

a label ply superposed on a liner ply having an adhesive therebetween, said label ply having a label face and a label periphery, and said liner ply defining an outer liner ply portion extending beyond at least a portion of said label periphery; and a barrier coating overlapping said label periphery of said label face and said outer liner ply portion of said liner ply so as to limit exusion of said adhesive beyond said barrier coating.

15. A label sheet comprising:

a liner ply having a ply face;

a plurality of label plies, each of said plurality of label plies having a label face;

an adhesive applied between each of said plurality of label plies and said liner ply; and, a barrier coating arranged to overlap at least a portion of each label face of said plurality of label plies and said ply face of said liner ply so as to limit said adhesive from exuding beyond said barrier coating by passing thereunder.

16. A label sheet according to claim 15, wherein each of said plurality of label plies have a first portion bound by a label periphery, and said barrier coating is applied to each of said plurality of label plies so as to substantially avoid respective ones of said first portions.

17. A label sheet according to claim 15, wherein said barrier coating bridges respective adjacent label peripheries.

18. A label sheet according to claim 15, wherein said barrier coating forms a continuous film.

19. A label sheet according to claim 15, wherein said barrier coating is selected from the group consisting of a protective varnish, a toner enhancement coating and a silicone.

20. A label sheet according to claim 15, wherein said liner ply has a liner face, said liner face coated substantially entirely with a release coating.

21. A label sheet according to claim 15, wherein:

said liner ply has a liner face;

said liner face pattern coated with a release liner defining at least one release coat free area; and, said barrier coating applied to each of said label plies such that at least a portion of said barrier coating overlies said at least one release coat free area.

22. A label sheet according to label 15, wherein said plurality of label plies are spaced apart on said liner ply so as to be non-abutting.

23. A label sheet according to label 15, wherein select ones of said plurality of label plies are spaced on said liner ply so as to be abutting.

24. A label comprising:

a form having a window of material removed therefrom;

a liner ply secured to said form such that said liner ply covers said window;

a label ply having a label face and a label periphery, said label ply positioned within said window and releasably held to said liner ply; and a barrier coating applied around at least a portion of said label periphery of said label face overlapping onto said liner ply within said window.

25. A label according to claim 24, wherein said barrier coating is applied around the entirety of said label periphery.

26. A label according to claim 24, wherein said barrier coating is applied over substantially the entirety of said label ply.

27. A label according to claim 24, wherein said label ply further comprises a first portion bound by said label periphery, wherein said barrier coating is applied to said label ply such that said barrier coating avoids said first portion.

28. A label according to claim 24, wherein said barrier coating comprises a continuous film.

29. A label according to claim 24, wherein said barrier coating is selected from the group consisting of a protective varnish, a toner enhancement coating and a silicone.

30. A label according to claim 24, wherein:

said liner ply has a liner face, a first region and a second region, said second region circumscribing said first region, and a release coating applied to said liner face, wherein said label ply is aligned substantially in register with said first region of said liner ply and said barrier coating overlaps over at least a portion of said label ply and at least a portion of said second region of said liner ply.

31. A label according to claim 30, wherein said release coating is pattern applied to said liner face defining a release coat free area, and said barrier overlies at least a portion of said release coat free area of said liner ply.

32. A label according to claim 30 wherein said release coating is applied to said liner face such that a majority of said second region defines a release coat free area, wherein said barrier coating overlies at least a portion of said release coat free area of said liner ply.

33. A label according to claim 32, wherein said barrier coating further extends from said liner ply onto said form adjacent to said window.

34. A label according to claim 24, wherein said form further comprises a fold line that intersects said window such that folding said form about said fold line breaks said barrier coating free from either said label ply or said liner ply.

35. A label according to claim 24, when said barrier coating further extends from said liner ply within said window to said form adjacent to said window.

36. A combination label and form comprising;

a form having a form face;

a liner ply adhesively held to said form;

a label having a label face and a label back, said label back releasably held to said liner ply; and a barrier coating applied to said label such that said barrier coating overlies at least a portion of said label face and extends onto said form adjacent to said liner ply, so as to limit said adhesive from exuding beyond said barrier coating by passing thereunder.

37. A label according to claim 36 wherein said label has a label edge, and said barrier coating straddles said label edge and extends onto said form adjacent to said liner ply.

38. A label according to claim 36 wherein said barrier coating overlies the entire label ply and extends onto said form adjacent to said liner ply.

39. A label according to claim 36 wherein said barrier coat forms a continuous film.

40. A label according to claim 36 wherein said barrier coating is selected from the group consisting of a protective varnish, a toner enhancement coating and a silicone.

41. A label sheet comprising:

a liner ply having a ply face;

a plurality of label plies, each of said plurality of label plies having a label face and a label periphery;

an adhesive applied between each of said plurality of label plies and said liner ply; and a barrier coating that overlaps and bridges at least a portion of said label peripheries of adjacent ones of said plurality of label plies on respective label faces, so as to limit said adhesive from exuding beyond said barrier coating by passing thereunder so as to become exposed on a face of said label sheet.

42. A label sheet according to claim 41, wherein select ones of said plurality of label plies are positioned on said liner ply so as to be generally abutting.

43. A label sheet according to claim 41, wherein select ones of said plurality of label plies are positioned on said liner ply so as to be generally non-abutting.

44. A label sheet according to claim 41, wherein each of said plurality of label plies are separated from adjacent ones of said plurality of label plies by die cuts.

45. A label sheet according to claim 41, wherein at least a portion of each label face is barrier coat free.

46. A label sheet according to claim 41, wherein said barrier coating further extends onto at least a portion of said liner ply.

47. A label sheet according to claim 46, wherein said ply face of said liner ply is coated with a release coating.

48. A label sheet according to claim 46, where said ply face of said liner ply comprises at least one release coat free area, and said barrier coating extends onto at least a portion of said release coat free area.

* * * * *